US010448716B2

(12) United States Patent
Heale

(10) Patent No.: US 10,448,716 B2
(45) Date of Patent: Oct. 22, 2019

(54) UMBRELLA

(71) Applicant: Richard David Heale, Southampton (GB)

(72) Inventor: Richard David Heale, Southampton (GB)

( * ) Notice: Subject to any disclaimer, the term of this patent is extended or adjusted under 35 U.S.C. 154(b) by 0 days.

(21) Appl. No.: 14/376,233

(22) PCT Filed: Jan. 17, 2013

(86) PCT No.: PCT/GB2013/050095
§ 371 (c)(1),
(2) Date: Aug. 1, 2014

(87) PCT Pub. No.: WO2013/114074
PCT Pub. Date: Aug. 8, 2013

(65) Prior Publication Data

US 2015/0129005 A1 May 14, 2015

(30) Foreign Application Priority Data

Feb. 3, 2012 (GB) ..... 1201912.1

(51) Int. Cl.
*A45B 25/22* (2006.01)
*A45B 25/18* (2006.01)
*A45B 23/00* (2006.01)

(52) U.S. Cl.
CPC ..... *A45B 25/22* (2013.01); *A45B 25/18* (2013.01); *A45B 2023/0006* (2013.01)

(58) Field of Classification Search
CPC ..... A45B 25/18; A45B 25/22; A45B 25/00; A45B 2023/00; A45B 2023/0006; A45B 25/02
USPC ..... 135/33.2, 33.4, 15, 33.41, 33.5, 27
See application file for complete search history.

(56) References Cited

U.S. PATENT DOCUMENTS 122,453 A * 1/1872 Gossip ..... 135/27
597,717 A 1/1898 Illoway
850,341 A * 4/1907 Callahan ..... A45B 25/22 135/27
922,925 A * 5/1909 Loukota ..... 135/25.31
(Continued)

FOREIGN PATENT DOCUMENTS

CN 201036370 2/2008
DE 19627766 8/1997
(Continued)

OTHER PUBLICATIONS

International Search Report from PCT for Application No. PCT/GB2013/050095, dated Jun. 5, 2013.

*Primary Examiner* — Winnie Yip
(74) *Attorney, Agent, or Firm* — Boulware & Valoir

(57) ABSTRACT

An improved umbrella (10) comprising: a shaft (11); a plurality of ribs(13) spaced around the shaft (11) arranged to be capable of extending outwardly of the shaft (11) in a deployed condition; a canopy (12) supportable by the ribs (13); and a tensioner (19) comprising a filamentary material which extends around the perimeter of the umbrella (10), wherein the filamentary material (19) is arranged to tension the perimeter of the umbrella (10) and resist inversion of the umbrella (10) by pulling a distal end of each rib (13) towards the shaft (11) when in the deployed condition.

12 Claims, 4 Drawing Sheets

(56) References Cited

U.S. PATENT DOCUMENTS

| | | | | | |
|---|---|---|---|---|---|
| 1,036,142 | A * | 8/1912 | Parker | A45B 19/10 | 135/25.31 |
| 1,431,775 | A * | 10/1922 | Cannon, Jr. et al. | 135/33.4 | |
| 1,622,273 | A * | 3/1927 | Anderson | 135/98 | |
| 2,200,897 | A * | 5/1940 | Ronkin | 135/33.5 | |
| 2,654,380 | A * | 10/1953 | Eichenbaum | 135/33.2 | |
| 3,032,047 | A * | 5/1962 | Wendorf | A45B 25/22 | 135/27 |
| 3,873,821 | A * | 3/1975 | Larson | 362/3 | |
| 4,300,582 | A * | 11/1981 | Desarno | 135/33.2 | |
| 4,370,994 | A * | 2/1983 | Pittman | A45B 19/02 | 135/20.2 |
| 5,131,422 | A | 7/1992 | Aronov | | |
| 5,429,147 | A * | 7/1995 | Barrington | 135/31 | |
| 7,806,131 | B1 * | 10/2010 | Seiler | 135/33.2 | |
| 7,882,846 | B2 * | 2/2011 | Harbaugh | 135/33.2 | |
| 2007/0125409 | A1 * | 6/2007 | Cullen | A45B 15/00 | 135/33.41 |
| 2012/0298159 | A1 * | 11/2012 | Di Cesare | A45B 11/00 | 135/20.1 |

FOREIGN PATENT DOCUMENTS

| | | | | |
|---|---|---|---|---|
| DE | 202007001402 | | 4/2007 | |
| EP | 1832195 | | 12/2007 | |
| JP | 2005349150 | A * | 12/2005 | A45B 19/00 |

* cited by examiner

UMBRELLA

TECHNICAL FIELD

This invention relates to umbrellas. One embodiment of the invention relates to wind resistant umbrellas comprising a tensioner at the periphery of the umbrella.

Umbrellas are used as portable canopies to protect the user from the weather including sun, rain and wind.

BACKGROUND

Known umbrellas have a canopy that can act as a shield against the sun, rain or wind. The canopy is usually roughly dome or cone shaped when in use and is made of flexible material. A frame keeps the canopy in shape and comprises a shaft with pivotally connected ribs radiating out at one end of the shaft and spreaders attached between the shaft and each rib to support the ribs and push them away from the shaft. The ribs are angled or bent towards the shaft to form the shape of the canopy. Many umbrellas are stowable by sliding the spreaders down the shaft and allowing the ribs to move to a position parallel to the shaft so that the canopy collapses and the umbrella is easier to transport or store. Folding umbrellas take this a stage further by also having one or more hinges in each of the ribs so that each rib can fold back on itself when the umbrella is stowed to make the stowed umbrella shorter. In these versions the shaft may also fold or be telescopic to reduce its folded length. Umbrellas are often made from light weight materials so that they are small and light to carry. Lightweight umbrellas are often made from relatively cheap materials and are inexpensive items.

A problem with many types of umbrellas, in particular lightweight, portable folding umbrellas, is that the umbrella can invert when a gust of wind hits the concave underside of the canopy. This pushes the ends of the ribs that hold the canopy in shape away from the shaft, if the end of one or more of the ribs straightens out or bends away from the shaft the canopy can easily invert. Inversion causes the umbrella to be less effective in windy conditions and can lead to damage to the umbrella, for example, the frame can break or bend or the canopy can tear.

We seek to provide an umbrella which is less prone to inversion in high wind conditions.

SUMMARY

According to a first aspect of the invention there is provided an umbrella comprising:

a shaft;

a plurality of ribs spaced around the shaft arranged to be capable of extending outwardly of the shaft in a deployed condition;

a canopy supportable by the ribs; and a tensioner comprising a filamentary material which extends around the perimeter of the umbrella, wherein the filamentary material is arranged to tension the perimeter of the umbrella and resist inversion of the umbrella by pulling a distal end of each rib towards the shaft when in the deployed condition.

One embodiment of the invention relates to a wind resistant umbrella comprising a tensioner at the periphery of the umbrella. It also relates to a method of manufacturing a wind resistant umbrella.

In one embodiment of the invention tension can be created at the perimeter of the umbrella, in the filamentary material and the ribs of the umbrella which advantageously increases the rigidity of the edge of the umbrella.

As the ends of the ribs are pulled towards the shaft the ribs may be curved to be bent and change the shape of the umbrella, as compared to its shape in the absence of the tensioner, so that the circumference at the edge of the canopy is reduced.

Tension in the ribs and/or the altered shape and smaller circumference of the edge of the umbrella canopy preferably make it more difficult for the umbrella to become inverted in high wind conditions. An advantage of the tensioner comprising a filamentary material is that the filamentary material can preferably be made from a light, strong material which will withstand the tension exerted on it by the ribs. There is no need for additional tension in the canopy compared to the tension in a standard umbrella and therefore the canopy may be made from standard materials. The relatively small amount of filamentary material used in the tensioner preferably does not add a significant cost to the materials in the umbrella.

Preferably the filamentary material is connected to a distal end of each rib so that the filamentary material connects said distal end of each rib to the distal end of each adjacent rib and pulls the distal ends of the ribs towards the shaft. This is advantageous because such an arrangement preferably reduces movement of the ribs as their ends at the perimeter remain spaced from each other. The force of a gust of wind that hits the underside of the umbrella is distributed around the filamentary material to more of the ribs.

Preferably the filamentary material is flexible, inextensible and has high tensile strength. The filamentary material is preferably resistant to corrosion, non-chafing, thin, weather resistant, and/or inexpensive. The filamentary material preferably being inextensible and strong means that it can resist the tension exerted by the ribs as they push away from the shaft at the perimeter of the umbrella. The filamentary material preferably is such that it will not break or wear and the wind resistance of the umbrella can be increased without increasing the tension in the canopy. Inextensible filamentary material preferably makes the circumference of the umbrella substantially inextensible, which preferably prevents it from stretching and starting to invert. In one embodiment the filamentary material may be attached to each of the ribs via an eye in the end of each rib. In another embodiment the filamentary material may be sewn into the canopy or threaded through a seam at the edge of the canopy. The filamentary material may go around the perimeter of the umbrella in a continuous loop.

Preferably the filamentary material forms a continuous loop around the perimeter of the umbrella. This is advantageous because it is simple to manufacture the umbrella by incorporating a single loop of string into the umbrella at the perimeter, for example by using a suitable length of filamentary material and joining the ends together to form a continuous loop.

Preferably the umbrella further comprises a slider movable along the shaft to deploy or stow the canopy and each stretcher is connected to the shaft via the slider. One end of the stretcher is preferably pivotally connected to one end of each of the ribs, and the other end of the stretcher is pivotally connected to the slider. As the slider moves along the shaft the stretcher pushes the rib away from the shaft to put up the umbrella or pulls the rib towards the shaft to stow the umbrella. This is advantageous because it allows the umbrella to be stowed, stored and transported easily.

Preferably the tensioner pulls the second end of each rib towards the shaft and each rib bends towards the shaft so that the circumference of the canopy is smaller than it would be without the tensioner. In one embodiment each rib is bent so that the second end of each rib is substantially parallel to the shaft of the umbrella when the umbrella is in use. Each rib is being forced to bend by the filamentary material and both the filamentary material and the ribs are under tension when the umbrella is in use. To cause the umbrella to adopt the stowed condition, the ribs are moved towards the shaft by the spreaders and the tension in the ribs and the tension in the filamentary material is released.

Preferably each rib of the umbrella comprises at least one hinge arranged so that the umbrella can be folded into the stowed condition. Each rib may comprise two, three or more than three portions each joined to the other by hinges. As the rib is moved towards the shaft, by sliding the slider, the one or more hinges preferably bends to cause one portion of the rib to fold back on itself next to another portion of the rib and the canopy to fold. This is advantageous because the effective length of the canopy when stowed may be smaller if the ribs of the umbrella are foldable. It is particularly advantageous to use a tensioning mechanism with a folding umbrella because the hinges can make the ribs more flexible and more likely to bend away from the shaft when the canopy is impacted by a gust of wind. The filamentary material preferably resists the ends of the ribs bending away from the shaft. The mechanism of many folding umbrellas requires that the distal portion of the rib, which is nearest to the perimeter of the umbrella, is not connected to a spreader. The distal portion of the rib is only supported by the canopy and is more vulnerable to bending away from the shaft of the umbrella, particularly at the hinge.

In one embodiment the filamentary material is attached to eyes or holes through each rib near the outer, distal end of each rib. This is advantageous because it is a simple method of securing the filamentary material to the end of each of the ribs. Many umbrellas are manufactured with eyes or holes near the end of each rib for the canopy to be secured to. Therefore, an umbrella according to the present invention can be made using a straightforward modification to the manufacturing process by securing the filamentary material to the eyes that exist in the ribs of a standard umbrella or umbrella frame. It is preferable and advantageous to secure the filamentary material to each of the ribs because tension can be created within the filamentary material and the ribs without putting additional tension on the canopy.

In one embodiment the tensioning filamentary material may be sewn into the perimeter of the canopy. The filamentary material can be used to sew around the perimeter of the canopy to form a strong loop around the canopy. The canopy may be shaped so that the circumference of the loop of filamentary material is a suitable size to pull the ends of the ribs towards the shaft of the umbrella when the canopy is in place on the umbrella and the canopy is open.

Preferably the canopy is substantially made from a lightweight fabric. The fabric may suitably be nylon or polyester. Preferably the fabric is a fabric used for the canopies of conventional umbrellas. Preferably the fabric is waterproof or water-resistant.

In one embodiment the ribs are made of aluminium and/or steel and/or fibreglass. Conventional umbrellas often have frames made from steel and/or aluminium. These conventional frames may be used to make an umbrella according to the present invention by including a tensioner preferably comprising a filamentary material. In another embodiment an umbrella according to the present invention may comprise a frame that comprises fibreglass to make the frame stronger and lighter. Preferably part or all of each rib may be made from fibreglass.

In one embodiment the tension of the umbrella may be distributed between the filamentary material and the frame of the umbrella. In this embodiment the canopy may not be under tension or may only be under enough tension to keep it in the correct shape laying over the frame. In one embodiment the canopy may be removable, replaceable or interchangeable with another canopy. In one embodiment the umbrella may be supplied with two or more interchangeable canopies.

Preferably the length of the filamentary material may be long enough to put sufficient tension on the ribs to prevent the umbrella from inverting in windy conditions. The tension required to prevent the umbrella from inverting depends on the dimensions of the umbrella, for example the size of the canopy and/or the shape of the umbrella. In one embodiment the ribs of the umbrella are flexible and tension created by the filamentary material bends the ribs towards the shaft of the umbrella so that the circumference is smaller than it would have been on the same umbrella without the filamentary material. In another embodiment the ribs are more rigid and the tension created by the filamentary material bends the ribs less or does not bend the ribs. In this embodiment the shape of the umbrella does not change but greater tension around the perimeter of the umbrella in the filamentary material and in the ribs resists inversion of the umbrella.

Preferably the umbrella does not invert and/or remains in the deployed condition when a gust of wind hits the underside of the umbrella at up to 10 meters/second (equivalent to 22 miles/hour), preferably up to 20 meters/second (equivalent to 45 miles/hour), more preferably up to 30 meters/second (equivalent to 67 miles per hour), even more preferably up to 40 meters/second (equivalent to 89 miles per hour). Preferably the umbrella does not invert and/or remains in a deployed condition when the wind speed hitting the underside of the umbrella is up to force 8 on the Beaufort scale.

In one embodiment the canopy is shaped to fit the shape of the ribs and filamentary material when they are under tension so that the canopy fits snugly over the ribs when the umbrella is in use. In one embodiment the sections of the canopy may have curved edges so that, when they are attached together they form a curved shape.

Preferably the filamentary material is inextensible and strong enough to withstand the tension exerted on it by the ribs. The filamentary material may also be non-corroding, non-chafing, waterproof, thin, flexible, UV resistant and/or inexpensive. The filamentary material may be made of any suitable material that has high enough tensile strength to withstand the tension required to resist inversion of the umbrella. Preferably the filamentary material comprises a thread, and is preferably of flexible, elongate form. In one embodiment the filamentary material may be a high tensile strength polyester filamentary material, for example a filamentary material used in sail making, for example ET138 filamentary material (V138) or ET207 filamentary material. In one embodiment the filamentary material may be Dabond 2000 Bonded filament Polyester Thread, a twisted, bonded and lubricated polyester filament thread for high speed industrial sewing. In one embodiment the tenacity of the filamentary material is at least 23 lbs (10432.62451 g).

BRIEF DESCRIPTION OF THE DRAWINGS

There now follows, by way of example only, a detailed description of various embodiments of the invention with reference to the accompanying drawings, in which.

DETAILED DESCRIPTION

Figure 1:
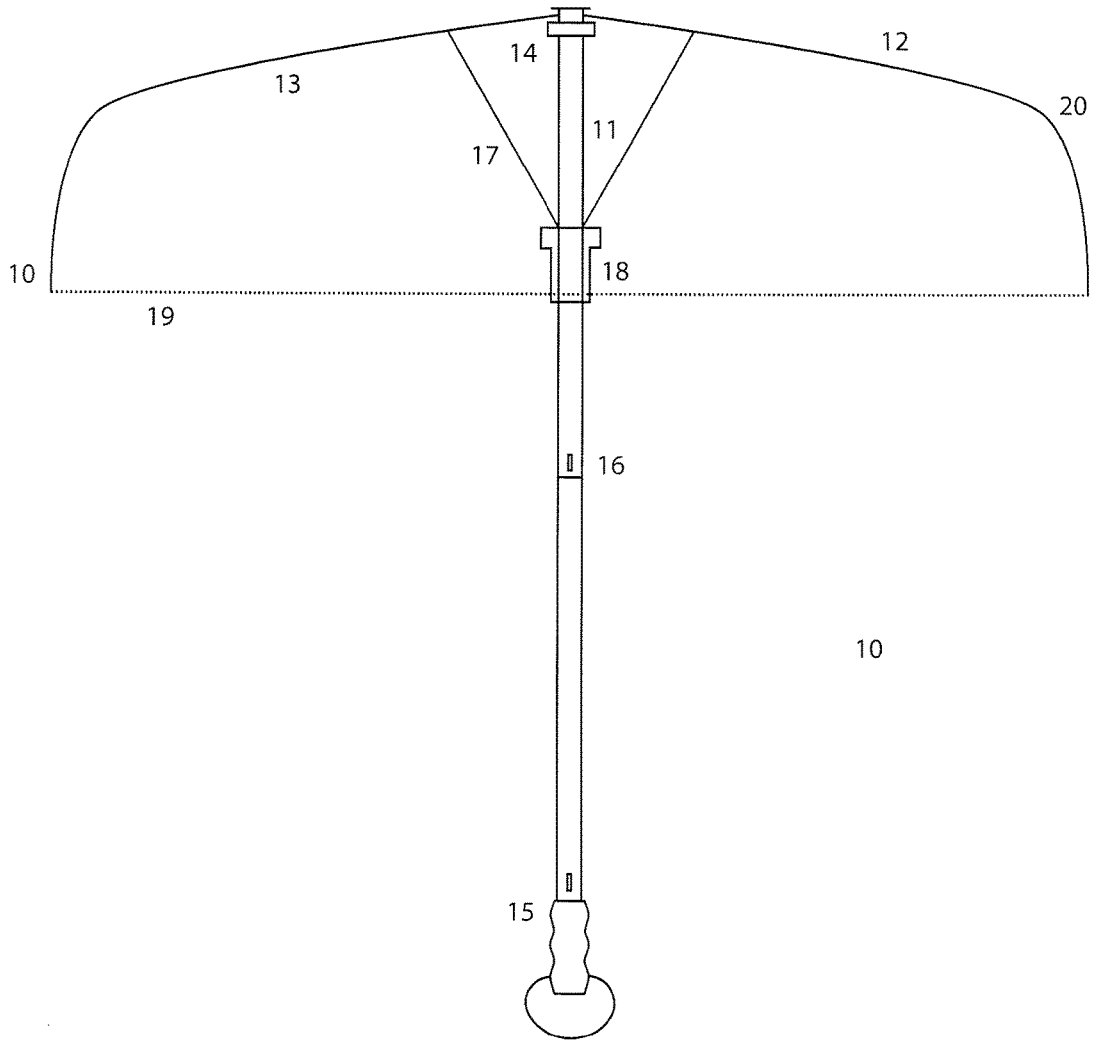
FIG. 1 shows a cross-section view of an embodiment of the invention.

FIG. 1 shows a portable umbrella 10, for protection against weather, for example, rain, sun or wind. In FIG. 1 the umbrella is shown in a deployed position where it is in use but the umbrella may also be moved into a stowed position where the canopy is collapsed.

Referring to the FIG. 1, an umbrella 10 comprises a shaft 11 and a canopy 12. The shaft comprises a rigid pole or tube and that is used to support the canopy and may be made from any rigid material, conveniently metal such as steel or aluminium or may be made from wood or plastic. The shaft 11 may be hollow in order to make it lighter and may also be telescopic or foldable so that it can be shortened when the umbrella is stowed. A ball spring 16 is shown in FIG. 1 that joins component parts which form a telescopic arrangement. The canopy 12 may be made from a flexible material and may be waterproof, shower-proof, UV resistant, light blocking and/or lightweight.

Ribs 13 are attached near one end 14 of the shaft. A handle 15 may be at the other end of the shaft for convenience in holding the umbrella. The ribs radiate out from near one end 14 of the shaft and are attached, at the other end or at a point between the two ends of the rib to a spreader 17, which pushes the rib away from the shaft to erect the umbrella for use. The other end of the spreaders may be attached to a slider 18, which slides along the shaft of the umbrella and positions the spreaders to erect or stow the umbrella.

Figure 4:
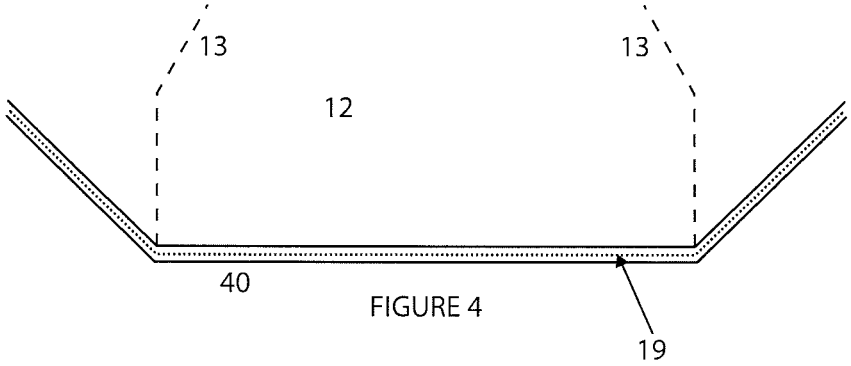
FIG. 4 is a partial view of a one tensioner embodiment.

The umbrella further comprises a filamentary material in the form of a thread 19 attached at or near the ends of each rib around the perimeter of the umbrella. The thread 19 serves to tension the perimeter of the canopy 12 when the umbrella is in a deployed condition. As shown in FIG. 4, the single length of thread 19 may be sewn into the periphery of the canopy, and passes around the perimeter. Alternatively, the thread 19 may be incorporated into the perimeter by way of passing through a sleeve in the canopy.

Figure 5:
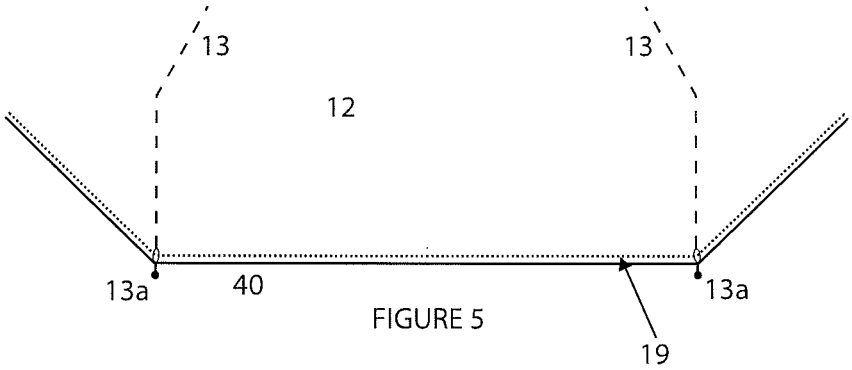
FIG. 5 is a partial view of another tensioner embodiment.

A further alternative tensioner embodiment is shown in FIG. 5, in which the thread 19 is attached to or through an eye 13*a* at the end of each of the ribs. In this embodiment the thread may not be inside a sleeve in the canopy. The thread may be external of the perimeter 40, but nevertheless forms a continuous loop around the perimeter 40 so as to tension the perimeter 40. In this embodiment the thread 19 extends through eyes 13*a*, located at the distal outer ends of the ribs 13.

Figure 6:
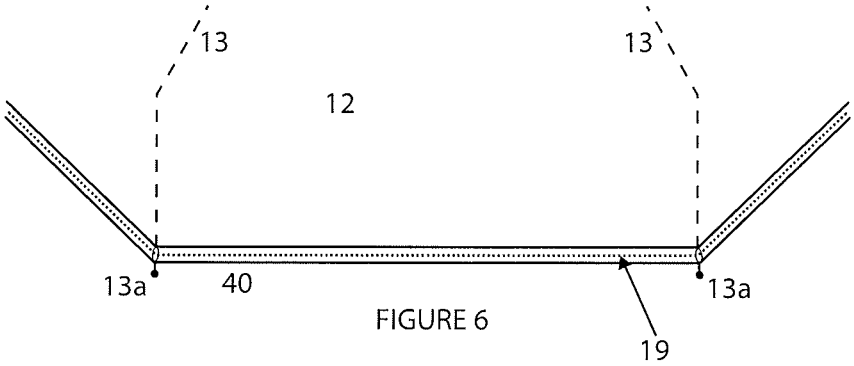
FIG. 6 is a partial view of another tensioner embodiment.

A further embodiment is shown in FIG. 6, in which the thread 19 is attached to or through an eye 13*a* at the end of each of the ribs and also runs through a sleeve in the canopy.

The filamentary material may be a suitable length that it applies tension to the ends of the ribs urging them towards the shaft of the umbrella.

Figure 2A:
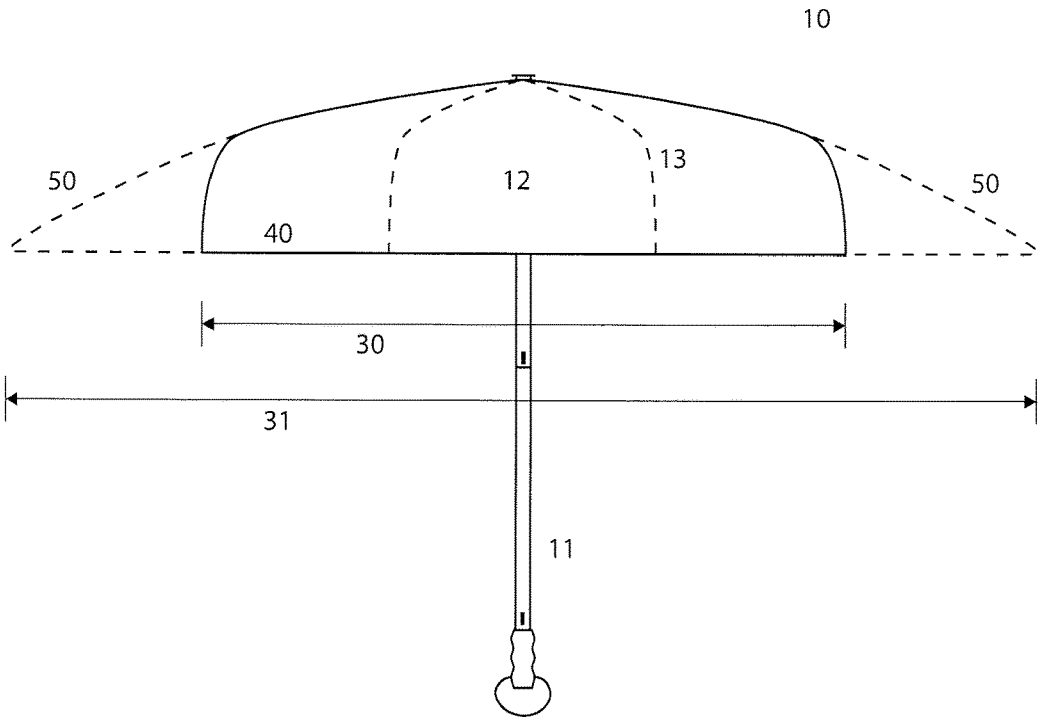
FIG. 2*a* shows a cross-section view of an embodiment of the invention showing the change in shape of the ribs when the tension in the filamentary material bends them.
Figure 2B:
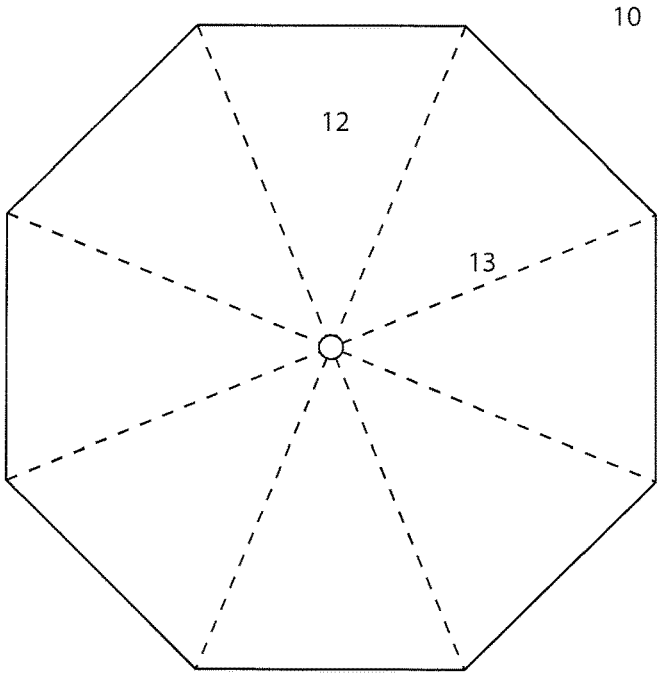
FIG. 2*b* shows view from the upper side of the umbrella.

In one embodiment the ribs may change shape and bend towards the shaft of the umbrella. FIG. 2*a* shows the effect that tension in the filamentary material may have on the shape of the umbrella. The broken outline 50 shows the spatial extent of the canopy in the absence of the filamentary material 19. With the presence of the tension applied by the filamentary material, the ribs are bent towards the shaft 11 of the umbrella. When the ribs bend, the circumference at the perimeter of the umbrella becomes smaller and hence the diameter of the edge of the umbrella becomes shorter and of smaller diameter 30, compared to the diameter 31 when the thread 19 is not present. Preferably the filamentary material is permanently attached to the edge of the umbrella so that the ends of the ribs are bent as the umbrella is erected into the position for use.

Figure 3:
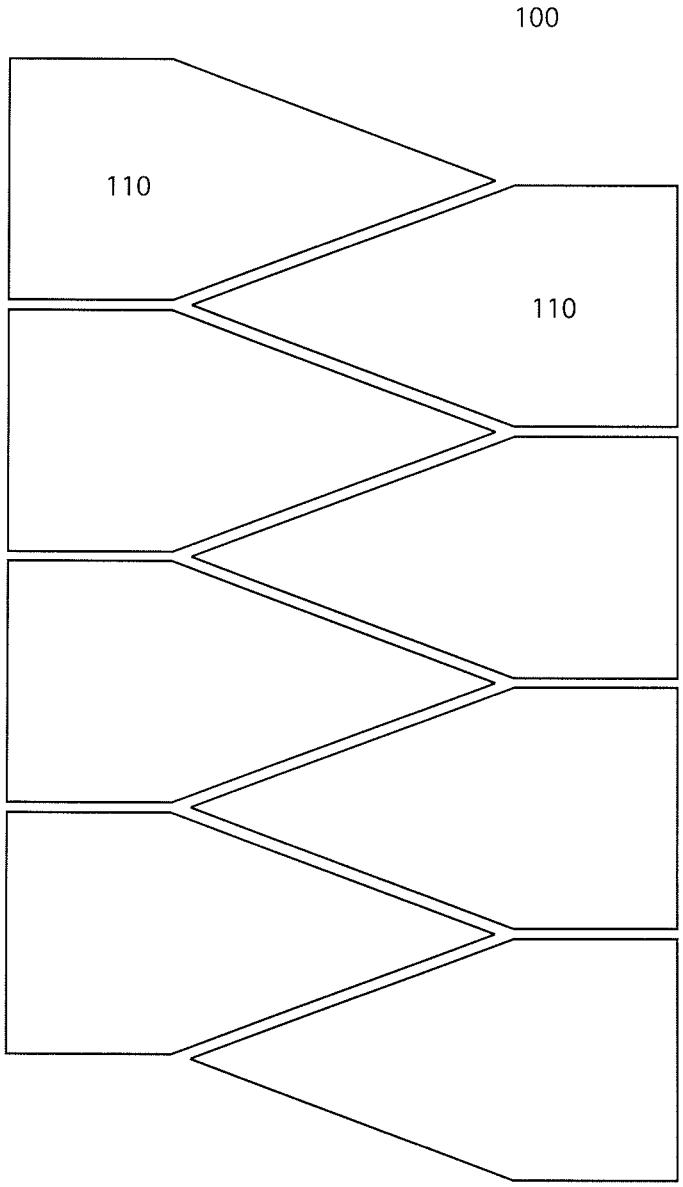
FIG. 3 shows a view how sections of canopy may be cut from a piece of fabric.

It will be appreciated that, in other embodiments, the application of tension applied by the thread does not, or does not appreciably, alter the shape of the ribs In order that the canopy fits snugly over the ribs when the umbrella is in use and the ribs are bent by the filamentary material, the canopy sections may be cut to a suitable shape. FIG. 3 shows a piece of canopy fabric 100 which has been cut into suitably sixed sub-pieces 110.

Although mention above has been made of a single length of filamentary material, in an alternative embodiment several pieces of filamentary material may be employed, each secured in tension to two eyes 13*a*, and spanning at least one section of the canopy at the perimeter.

The invention claimed is:

1. An umbrella comprising:

an umbrella frame comprising a shaft;

a plurality of ribs spaced around the shaft, arranged to be capable of extending outwardly of the shaft in a deployed condition;

a canopy supportable by the ribs; and a tensioner comprising filamentary material which contacts a perimeter of the canopy and extends around said perimeter, wherein the filamentary material is connected to a distal end of each rib so that the filamentary material connects the distal end of each rib to the distal end of each adjacent rib and pulls the distal ends of the ribs towards the shaft and reduces a circumference at the perimeter of the canopy to tension the perimeter of the canopy so as to resist inversion of the umbrella by pulling a distal end of each rib towards the shaft when in the deployed condition.

2. An umbrella according to claim 1, wherein the filamentary material is flexible and inextensible.

3. An umbrella according to claim 1, wherein the filamentary material forms a continuous loop around the perimeter of the canopy.

4. An umbrella according to claim 1 wherein the filamentary material is incorporated into the perimeter of the canopy.

5. An umbrella according to claim 1, further comprising a slider movable along the shaft to deploy or stow the canopy, wherein a plurality of stretchers are connected to the shaft via the slider.

6. An umbrella according to claim 1, wherein each rib comprises at least one hinge arranged so that the umbrella canopy can be folded.

7. An umbrella according to claim 1, wherein the filamentary material is attached to an eye at the distal end of each rib.

8. An umbrella according to claim 1, wherein the filamentary material forms a closed loop with a circumference smaller than the circumference of the ends of the ribs so that when the filamentary material is attached to the ribs it pulls the ends of the ribs towards the shaft.

9. An umbrella according to claim 1, wherein the canopy is shaped so that it fits the umbrella frame when ends of the ribs are pulled towards the shaft by the filamentary material.

10. An umbrella according to claim 1, wherein said shaft and/or said ribs are arranged to be foldable from a stowed condition to a deployed condition and vice versa.

11. An inversion-resistant umbrella comprising:

a shaft;

a plurality of ribs spaced around the shaft, arranged to be capable of extending outwardly of the shaft in a deployed condition, wherein each rib has a distal and proximal end and a hinge wherein said ribs are foldable;

a canopy supportable by the ribs; and a tensioner comprising a flexible and inextensible filamentary material which contacts a perimeter of the canopy and extends around said perimeter, wherein the filamentary material tensions the perimeter of the canopy by pulling the distal end of each rib towards the shaft when in the deployed condition to bend each rib towards the shaft to reduce a circumference at the perimeter of the canopy.

12. An umbrella comprising:

a shaft;

a plurality of ribs spaced around the shaft, arranged to be capable of extending outwardly of the shaft in a deployed condition;

a canopy supportable by the ribs; and a tensioner comprising a flexible and inextensible filamentary material which contacts a perimeter of the canopy and extends around said perimeter, wherein the filamentary material is arranged to tension the perimeter of the canopy so as to resist inversion of the umbrella by pulling a distal end of each rib towards the shaft when in the deployed condition wherein each rib bends towards the shaft so that a circumference at the perimeter of the canopy is smaller than it would be without the tensioner, wherein said filamentary material has a tenacity of at least 23 lbs.

* * * * *